US008893451B2

(12) United States Patent
Rodriguez

(10) Patent No.: US 8,893,451 B2
(45) Date of Patent: Nov. 25, 2014

(54) BUILDING BLOCK FOR CONSTRUCTION OF BUILDINGS AND ITS PROCEDURE

(75) Inventor: Osvaldo Nestor Rodriguez, Ciudad Autonoma de Buenos Aires (AR)

(73) Assignees: Beuchat, Barros & Pfenniger, Santiago (CL); Osvaldo Nestor Rodriguez, Ciudad Autonoma de Buenos Aires (AR)

( * ) Notice: Subject to any disclaimer, the term of this patent is extended or adjusted under 35 U.S.C. 154(b) by 0 days.

(21) Appl. No.: 13/574,112

(22) PCT Filed: Jan. 19, 2011

(86) PCT No.: PCT/CL2011/000005

§ 371 (c)(1),
(2), (4) Date: Jul. 19, 2012

(87) PCT Pub. No.: WO2011/088586

PCT Pub. Date: Jul. 28, 2011

(65) Prior Publication Data

US 2012/0291365 A1 Nov. 22, 2012

(30) Foreign Application Priority Data

Jan. 19, 2010 (AR) ..... 20100100109

(51) Int. Cl.

| | |
|---|---|
| ***E04H 1/00*** | (2006.01) |
| ***E04B 1/00*** | (2006.01) |
| ***E04B 1/343*** | (2006.01) |
| ***E04B 1/348*** | (2006.01) |
| ***E04B 1/19*** | (2006.01) |

(52) U.S. Cl.

CPC . *E04B 1/343* (2013.01); *E04B 1/00* (2013.01); *E04B 1/34331* (2013.01); *E04B 1/3483* (2013.01); *E04H 1/00* (2013.01); *E04B 1/348* (2013.01); *E04B 1/19* (2013.01); *Y10S 52/10* (2013.01)

USPC ..... 52/653.1; 52/79.1; 52/DIG. 10

(58) Field of Classification Search

USPC ..... 52/79.1, 79.2, 79.4, 653.1, 652.1, 646, 52/DIG. 10

See application file for complete search history.

(56) References Cited

U.S. PATENT DOCUMENTS

| | | | | | |
|---|---|---|---|---|---|
| 2,178,667 | A | * | 11/1939 | Littlefield | 52/655.1 |
| 3,618,273 | A | | 11/1971 | Crandall | |
| 3,710,528 | A | | 1/1973 | Riedberger et al. | |
| 3,974,600 | A | | 8/1976 | Pearce | |
| 4,037,371 | A | | 7/1977 | de la Lande de Calan | |
| 4,258,479 | A | * | 3/1981 | Roane | 434/211 |
| 4,667,451 | A | * | 5/1987 | Onoda | 52/646 |
| 4,722,162 | A | * | 2/1988 | Wilensky | 52/652.1 |
| 4,745,725 | A | * | 5/1988 | Onoda | 52/646 |
| 4,819,399 | A | * | 4/1989 | Onoda | 52/646 |
| 4,869,041 | A | | 9/1989 | Chu | |
| 5,016,418 | A | * | 5/1991 | Rhodes et al. | 52/646 |

(Continued)

FOREIGN PATENT DOCUMENTS

| | | |
|---|---|---|
| AR | 026905 | 3/2003 |
| CL | 000106277 | 8/2002 |

(Continued)

*Primary Examiner* — Andrew J Triggs

(74) *Attorney, Agent, or Firm* — Hamre, Schumann, Mueller & Larson, P.C.

(57) ABSTRACT

The invention relates to the construction of buildings, especially a reticulated stereo modular element that, combined with other identical elements, enables the construction of quadrangular enclosures suitable for the construction of rooms.

16 Claims, 4 Drawing Sheets

(56) References Cited

U.S. PATENT DOCUMENTS

| | | | | |
|---|---|---|---|---|
| 5,105,589 | A * | 4/1992 | Rodriguez | 52/79.1 |
| 5,125,206 | A * | 6/1992 | Motohashi et al. | 52/646 |
| 5,331,779 | A * | 7/1994 | Hing | 52/80.1 |
| 2012/0291365 | A1* | 11/2012 | Rodriguez | 52/79.9 |

FOREIGN PATENT DOCUMENTS

| | | |
|---|---|---|
| FR | 1226372 | 7/1960 |
| NL | 7101636 | 8/1971 |
| NL | 7509025 | 2/1976 |
| WO | WO 02/44487 | 6/2002 |

* cited by examiner

BUILDING BLOCK FOR CONSTRUCTION OF BUILDINGS AND ITS PROCEDURE

TECHNICAL SECTOR

This invention is linked to the construction of buildings in general, more particularly with a reticulated stereo modular element that combined with others that are the same permits the construction of square enclosures suitable for the construction of rooms.

PRIOR ART

The most direct antecedent is U.S. Pat. No. 5,105,589 that belongs to the creator of this invention, architect Osvaldo N. Rodriguez.

According to its claim 1, it consists of a modular structure for houses identified because the combination consists of a plurality of tetrahedral cells placed horizontally and vertically in an accumulative manner to form multiple spaces of habitation and homes. Each cell composed of six bars, two of which (9-12) are spaced horizontally, crossing each other at 90° angles. The other four remaining cells (3, 4, 5 and 6) are placed diagonally with those mentioned previously (9-12), a first pair of said four bars (3-4) having some first lower ends joined or the opposite ends of one of said crossed bars (12) and some first upper ends joined to one end of the other crossed bar (9). A second pair of the four bars (5-6), having some second lower ends joined to the ends opposite to said crossed bar (12) and to the other adjacent inferior end of each first of four bars (3-4) and having some second upper ends joined together and at the other end of said crossed bar (9). These six bars form the borders of a tetrahedral cell, that pair of diagonal bars (3, 4, 5 and 6) corresponding to the lateral faces of a virtual cube that defines a habitable space of the house, those crossed bars (9-12) of each set tallying with diagonal bars of opposing bases of the virtual cube, the bars forming the borders of the tetrahedral cell coinciding with bars of a set immediately adjacent to provide consecutive habitable spaces selected vertically and horizontally, at least one of those bars (9) having reinforcement means of the load time, that include an element similar to a bar element (10) and a structure fenced with laths between the bar (9) and the element similar to a bar (10), and where the remaining bars of the mentioned bars are free of the reinforcement means.

This U.S. patent of the appellant resorts to a tetrahedron modified by means of one of the bars transformed into a kind of lattice girder, as support for the upper floors and other differences that appear in the claim.

Another execution belonging to the same inventor is Chilean patent P00 01 06 277 and Argentine patent N° AR 026905 B1 referring to "A structural building block for the construction of living spaces in a theoretically infinite series in horizontal and vertical planes, by juxtaposition of the same in relation to similar building blocks".

It consists of a structural building block for the construction of living spaces in buildings that offers the possibility of reconciling a resistant pyramidal structure with the cubic configuration of a living space, which includes at least one resistant pyramidal structure unit of bars placed according to a semi-octahedral form that permits the definition of a base for the building block and mutually orthogonal walls and with regard to the base to delimit semi-cubic spaces that when complemented with semi-cubic spaces of juxtaposed building blocks form living spaces arranged in an endless series horizontally and vertically.

As illustrated, part of a semi-octahedron that is aligned laterally with other similar ones symmetrically as if it were a checkerboard on the flat of the base. Another checkerboard base is placed between the vertexes of each building block, leaving a space between vertexes and the flat of the base of the following row that is covered by the flats of the walls.

In its summary we find the differences between the structure described in this documentation and the structure resulting from the appellant's embodiment. Each plant is formed by joining the modular structures claimed, one beside the other. The remaining spaces of each semi-octahedron are covered with the panels that form the walls.

U.S. Pat. No. 3,710,528, that is common knowledge, has the title "Structures for buildings". Each plant is formed by joining the modular structures claimed, one beside the other. Its summary mentions that it consists of a structure with a skeleton in perforated units and tetrahedral units, some of which have their apex in a first horizontal plane and the others have their apex in a second plane, the edges of each tetrahedral unit being the common edges of an adjacent octahedral unit. Beams arranged along the edges of these tetrahedral and octahedral units, of rectangular panels located in the vertical planes defined by the edges of the tetrahedral unit that are added to those beams members of a hexagonal panel are placed in the first and second planes. The hexagonal and rectangular panels define cells shaped like hexagonal prisms.

In this embodiment, the elemental tetrahedral and octahedral building blocks are fitted together adjacently to combine them, making their respective apexes coplanar in successive planes. This composition is complemented with beams placed on their edges. A genesis structure that is different to the one described in this documentation.

U.S. Pat. No. 4,869,041, which was recently made public knowledge, is a "Special framework with octets and components to assemble it". It consists of a plurality of identical cross braces using the geometry of the octahedral/tetrahedral (octets) in which the cross braces instead of being simple tubular members are manufactured as longitudinal spatial structures. A second aspect of the invention is concerned with a connecting piece to orient and join the ends of the cross braces for structures of octets.

In one embodiment the connecting piece has the shape of two interpenetrating tetrahedrons allowing the installation and removal of individual cross braces without disturbing the other cross braces. Retention members are described that do not require tools for the assembly.

There are several differences that identify this U.S. Pat. No. 4,869,041 with regard to this invention. They are derived from the geometry of the octahedron/tetrahedron, the interpenetrating tetrahedrons that allow the elimination of cross braces that are components of the structure and the retention means incorporated for the coupling of the structure's different components.

U.S. Pat. No. 4,722,162, which is also public knowledge, refers to "An octagonal structure made up of multiple regular tetrahedral lattice cells".

The regular tetrahedral lattice cells (RTLs) can be used as construction blocks in one, two and three in dimensional structures of superior conditions of lightness, resistance and rigidity. The reticulated structures can be thought as consisting of at least three imaginary borderless cubes, where each cell contains a pair of RTLs and each pair of them is formed entirely from six elements crossed in straight angles of arms of equal length, joined at the eight vertexes. Each one of the eight vertexes corresponds to a corner of an imaginary cubic cell and each one of those cubic cells together with another of those pairs of RTLs, share an interface with at least another cubic cell and the pair of RTLs of said latticed structure. These structures can be formed in strings in a straight line and crosses in three-dimensional right angles helping conventional constructions with simple methods of manufacture and rapid on-site repairs.

A lattice structure is claimed in the patent that consists of at least three imaginary cubic cells devoid of edges, where each cell contains a pair of regular tetrahedral latticed structures and each pair of regular tetrahedral structures is formed solely of 6 elements crossed at right angles equally assembled of equal length joined in 8 vertexes each vertex equivalent to one corner of one of said cubic cells with each one of said cubic cells, together with each one of that pair of regular tetrahedral structures sharing an interface with at least another cubic cell and the pair of regular cubic cells of that latticed structure.

The combination of the tetrahedral building blocks that in specific parts manages to form a skeleton and crosses in straight angles reappears registered. These situations are found in this invention comprising only elementary tetrahedral building blocks and tension members or braces are added that did not exist in previous embodiments.

DISCLOSURE OF THE INVENTION

Conceptually the reticulated stereo building block for construction of buildings is made up of a plurality of conventional tetrahedral elements incorporating into each one of them a pair of tension members of a specific length, equal to the height of the tetrahedral, attaching them to a pair of its vertexes thereby constructing a building block; for the building of a single floor of at least one room, a single building block is used and two of the vertexes of the tetrahedral are anchored to the foundation and one of said tension members is fixed in position by one of its ends to one of the vertexes of the tetrahedral, while the other tension member is also fixed to another of the vertexes belonging to the same tetrahedral, so that the direction of the mentioned tension members mounted in parallel are oriented in the vertical direction of the construction; between each one of the respective ends of each tension member and the vertex of the tetrahedral fixed to the foundation there is an integral square floor panel that completes the dwelling with the wall panels, at least one of which has the openings, finishing the room with the roof panel fixed to the structure thus formed; for the building of at least a second floor, a second building block rotated in 90° is juxtaposed to the unit mounted for the first floor, the lower horizontal bar of the building block coinciding with the upper horizontal bar of the building block of the first floor ground plan. The corresponding tension members are fixed to the respective vertices, the square floor panel that constituted the roof of the first floor ground plan is mounted; the same procedure is continued successively for each ground plan, alternating the building blocks until the required height has been completed.

Another purpose of this invention is to provide a simple modular stereo reticulated arrangement made up of resistant profiles and by combining them obtain the skeleton or reinforcing bars to support rooms whose skeleton can be assembled in extended floor plans both in longitudinal adjacent shapes as well as superimposed vertically.

The fundamental purpose of this invention is to provide a new embodiment defined by a single building block, by means of which, by adding some tension members the necessary panels are added for the formation of the floor, ceiling and walls necessary for the construction of the dwelling.

Another purpose of the invention that will be described below is that of obtaining the structure that defines the reinforcing bars of a building with characteristics of great resistance capable of withstanding tensile stress, compression and bending of any nature, both of own loads as well as those of a natural origin such as strong winds. Thus resulting in an earthquake-proof structure.

Another purpose of this invention consists of the following procedure to obtain diverse constructions, applying the reticulated stereo building block of the invention.

In order to understand this invention that consists of "A reticulated stereo building block for the construction of buildings and its procedure", so that it may be put into practice easily, a precise description of a preferred embodiment will be given in the following paragraphs, referring in it to the illustrative drawings that are attached, all this as a purely demonstrative but not limitative example of the invention, whose components may be selected from among various equivalents without departing from the principles of the invention established in this documentation.

BRIEF DESCRIPTION OF THE DRAWINGS

In the diagrammatic drawings attached to this technical-legal description, we have that.

In the figures described above, the same reference characters indicate like or corresponding parts.

DETAILED DESCRIPTION OF THE DRAWINGS

Figure 1:
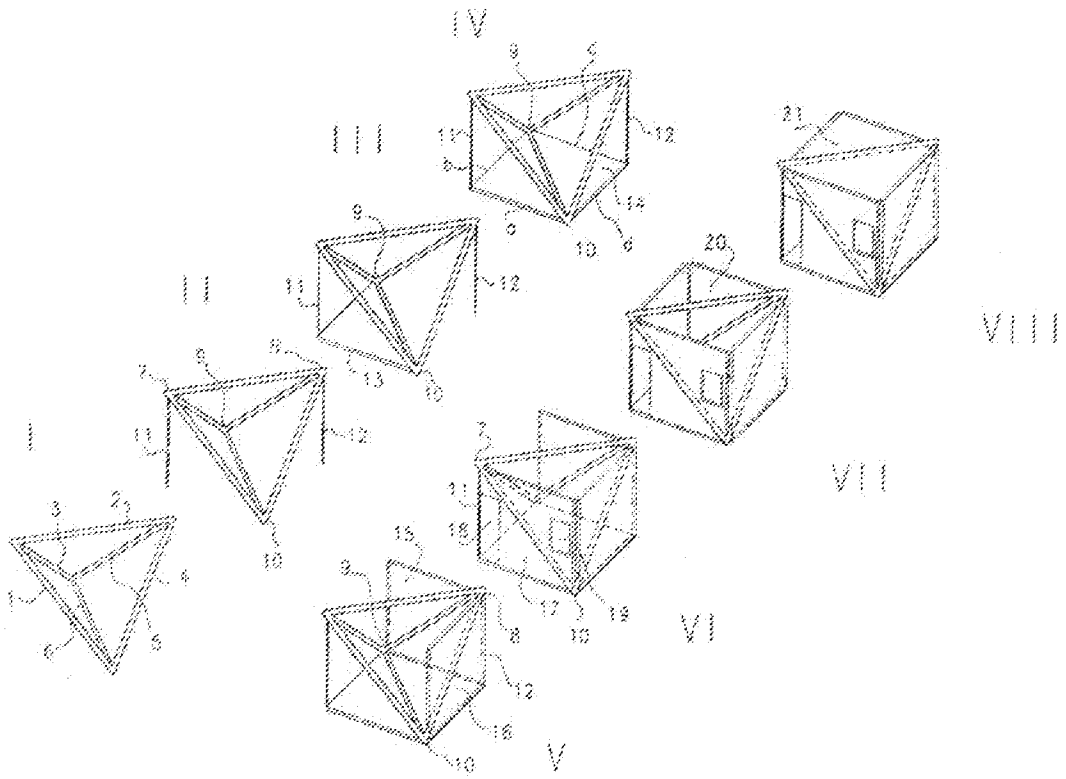
FIG. 1 represents a perspective view, following the sequence of the invention, of how a basic reticulated stereo building block is generated based on its essential component elements to arrive at the building of a habitable room.

FIG. 1 is an illustration of a succession of images that illustrate the construction process of a single room. This unit, when repeated, will multiply the number of rooms of a specific building.

The basic elements are represented in -I- and -II- by a tetrahedron built by means of six profiles, successively named as bars -1-, -2-, -3-, -4-, -5- and -6- perfectly fixed to each other by their respective ends, resulting in the vertexes -7-, -8-, -9-, -10-.

The section of the bars will be chosen in accordance with the loads and stresses they will have to experience in the construction.

In FIG. 1-II one can see the tetrahedron with the addition of two tension members in a pair of its vertexes -11- and -12-.

In the following FIG. 1-III half a floor panel -13- is added attached to the end of the tension member -11- and the vertexes 9 and 10.

Continuing with FIG. IV one can see that the floor -14- of the unit has been completed, by means of another half floor panel, using the tension member -12- to keep it in position with the vertexes 9 and 10. The floor is supported on the vertexes that coincide with the ends of the tension members and the horizontal bar coinciding with the floor.

Passing to FIG. V, between the vertex -8- the tension member -12- and the vertex -10- the panel corresponding to the room dividing wall designated with number 16 has been added. Between the vertex 8, the tension member 12 and the vertex 10*a* the room dividing wall designated with number 15 has been added.

In the following FIG. VI, the front panel -17- has been incorporated between the vertex -7-, the tension member -11- and the vertex -10-. Incorporated into this front panel -17- are the access door -18- and a window -19-.

In FIG. VII the last panel -20- has been incorporated into the cell, completing the room in VIII with the roof -21-.

Figure 2:
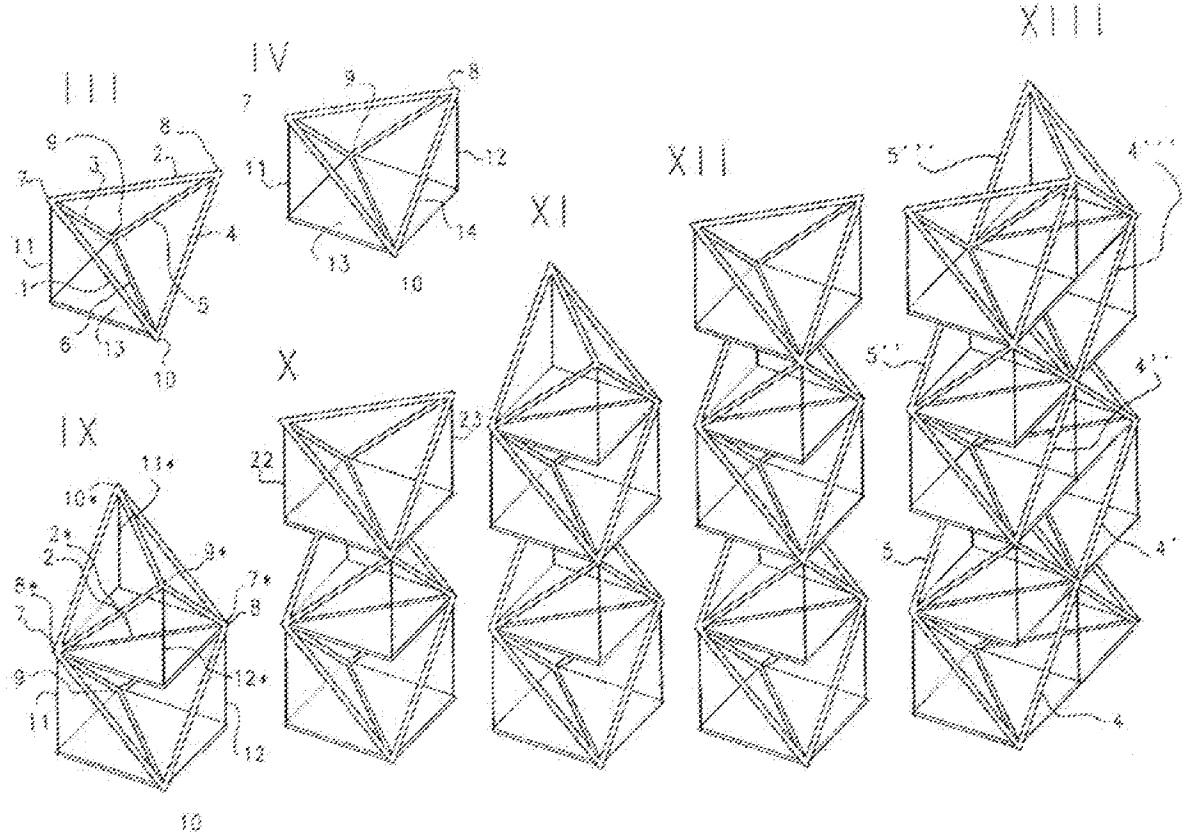
FIG. 2 consists of another partial perspective view, following the assembly sequence of the successive elements stacked in order to obtain the skeleton in various floor plans of a building. The last of the series corresponds to two adjacent units.

In FIG. 2, sketches III and IV built in the same manner explained above, the outcome is that in the reticulated tetrahedron the ground plan of the floor is formed with the help of the tension members -11- and -12- and the half panels -13- and -14-.

We now see in sketch IX, that in order to build another ground plan on top of it, one must resort to a modular assembly similar to the one already obtained in II but rotated 90°. One can now observe the coincidence of vertexes -7- initial with the -8$^{th}$- of the second tetrahedron and the -8- with the -7$^{th}$-. The -9$^{th}$- and the -10$^{th}$- appear at the distal end of the assembly. The bar -2- of the first tetrahedron coincides with the -2$^{nd}$- of the second tetrahedron and the tension members of the second -11$^{th}$- and 12$^{th}$- now become dependent on the -9$^{th}$- and -10$^{th}$- vertexes.

In sketch X, the basic modular assembly of the third tetrahedron crosses once again, remaining in a position that is the same as that of the first one used as a base and continues thus for all the following XII sketches and for the first column of sketch XIII.

Figure 3:
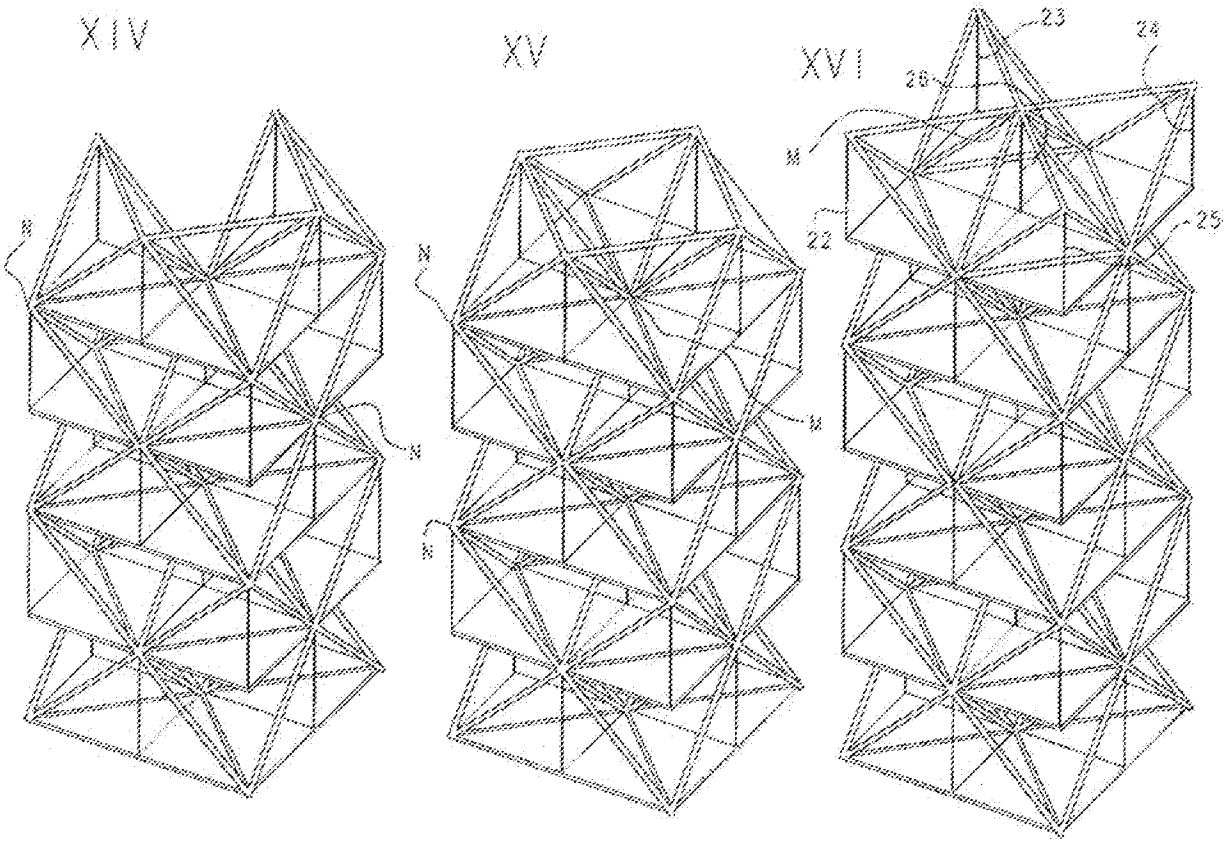
FIG. 3 is a partial perspective view of a skeleton of several floor plans with the floor in place under construction. The illustration of the example only has four cubicles to form four adjacent rooms.
Figure 4:
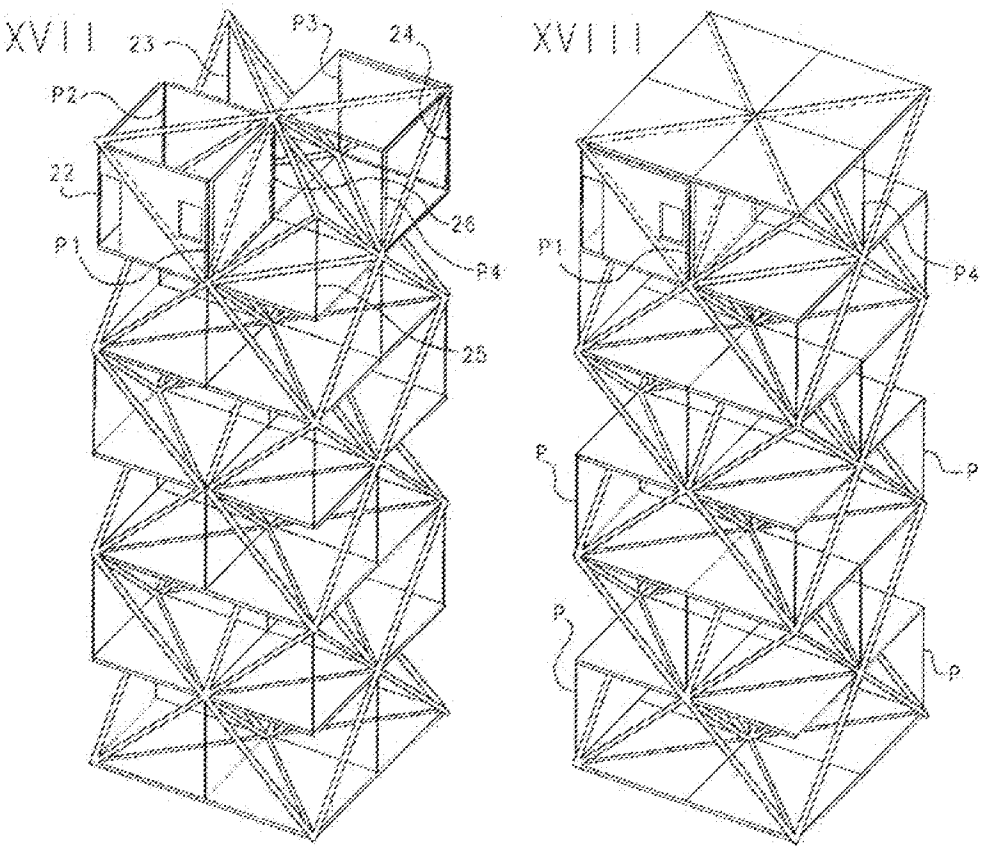
FIG. 4 corresponds to a perspective of the skeleton illustrated in the preceding figure, drawn here for six floor plans, with a roofless room provided with a door and a window.

It is of importance to note that the tension members "hanging" from the respective knots can be replaced by stanchions -P- and point out especially that they are necessary for the last floor. See FIGS. 3 and 4.

In all the cases the foundation will obviously be the appropriate one for the total mass of the building.

In diagram XIII there are two adjacent columns that will be mounted in the same way, alternating the basic building blocks and their tension members. It can be seen in the figure that the profiles that remain in view designated with -4- and the successive -4'-, -4"-, and -4'"- will remain aligned. The same will occur with the -5- in the distal face of the building. The panels needed for the walls will have the openings that may be necessary according to the layout of each different construction.

All the sketches that are included in the different building possibilities are developed in a similar manner. (See explanation in the figures.)

It is interesting to observe how some floors remain suspended from their tension members from the meeting knots -N- of the vertexes of the tetrahedrons that coincide in the exteriors or also in the interiors -M-.

The procedure for the construction of buildings, according to the above description, is developed according to the following steps:

Step 1, the adequate foundation for the building is prepared and the first tetrahedral building blocks are anchored by two of their free vertexes, in such a way that the tension members mounted on the remaining vertexes remain supported on that base;

Step 2, the quadrangular floor plate is mounted by halves so that three of its consecutive corners coincide with the two ends of the tension members and two of the vertexes of the first tetrahedron;

Step 3, the adjacent assemblies are mounted until the ground floor has been completed, arranging the successive modular assemblies in such a way that the external bars that form part of each one adopt opposite inclinations;

Step 4, the vertexes that coincide are attached to one another, the floor and roof plates are mounted together with the wall panels, provided with planned openings;

Step 5, modular assemblies are juxtaposed to set up a second floor, with its tension members or stanchions placed at 90° of those of the first floor and to fix rigidly with one another the vertexes that coincide in each knot, mount the respective floor and ceiling plates;

Step 6, the same procedure continues successively for each floor plan, alternating the building blocks until the required height has been completed.

Once the different components of the version of the invention have been established, developed to explain their nature, the description is then complemented with the functional and operational relationship of its parts and of the result they provide.

To simplify the explanation, during the constructive description of the invention, details of the mounting have been introduced that contribute to show the function of each element of significance.

It is important to highlight that the reticulated stereo layout of each building block is the origin, during the construction, of meeting knots of the vertexes of these, in which a good inter-linkage must be provided that unifies the static and dynamic conditions of each one. In principle, electric welding can be used or the providing of a means that acts as intermediary in each vertex to make it easier. In the same case or in general just in case the bars are of different materials.

The manner in which the building blocks are arranged, oriented in different directions, permits the construction to acquire a great structural resistance in any spatial direction in which it may be requested due to future overloads.

In this way we have described one of the constructive possibilities that lead to the implementation of the invention and the manner in which it functions, complementing the documentation with the synthesis of the invention contained in the claims that are added below.

The invention claimed is:

1. A multi-floor building, comprising:

at least first and second floors, the first and second floors each including a building block that consists essentially of:

a tetrahedral element that includes six bars fixed to each other at four vertexes, two of the vertexes being lower vertexes and two of the vertexes being upper vertexes disposed at a vertical location above the two lower vertexes;

first and second tension members, the first tension member including a first end that is fixed to a first one of the upper vertexes and a second end, and the second tension member including a first end that is fixed to a second one of the upper vertexes and a second end, and the first and second tension members are parallel to each other and are oriented in a vertical direction; and a square floor panel that is oriented horizontally, the square floor panel is fixed to the second ends of the first and second tension members and is fixed to the two lower vertexes;

wall panels, at least one of which is provided with openings, and a ceiling panel;

the building block of the second floor is rotated 90 degrees about a vertical axis relative to the building block of the first floor so that the tension members of the building block of the second floor are disposed above the two lower vertexes of the building block of the first floor.

2. A multi-floor building according to claim 1, wherein said square floor panels and walls comprise triangular halves.

3. A multi-floor building according to claim 1, wherein the building includes a third floor that includes a building block that consists essentially of:

a tetrahedral element that includes six bars fixed to each other at four vertexes, two of the vertexes being lower vertexes and two of the vertexes being upper vertexes disposed at a vertical location above the two lower vertexes;

first and second stanchions, the first stanchion including a first end that is fixed to a first one of the upper vertexes and a second end, and the second stanchion including a first end that is fixed to a second one of the upper vertexes and a second end, and the first and second stanchions are parallel to each other and are oriented in a vertical direction; and a square floor panel that is oriented horizontally, the square floor panel is fixed to the second ends of the first and second stanchions and is fixed to the two lower vertexes.

4. A multi-floor building according claim 1, wherein the six bars of each building block include a horizontal floor bar and a horizontal ceiling bar, the floor bar and the ceiling bar are arranged at 90 degrees to one another; and the horizontal floor bar of the building block of the second floor is parallel to and coincides with the horizontal ceiling bar of the building block of the first floor.

5. A procedure of constructing the multi-floor building of claim 1, wherein the procedure comprises:

a. preparing a base for the building and anchoring a plurality of the tetrahedral elements to the base;

b. assembling the square floor panel of each building block so that three consecutive corners coincide with the second ends of the tension members and the two lower vertexes of each tetrahedron;

c. completing the first floor with each tetrahedral element being positioned in such a way that external bars of the six bars that form each tetrahedral element adopt opposing inclinations;

d. attaching coinciding vertexes of adjacent tetrahedral elements, and mounting the wall panels and the ceiling panels;

e. forming the second floor by arranging a plurality of the tetrahedral elements rotated 90 degrees about a vertical axis relative to the tetrahedral elements of the first floor and mounting the respective floor and ceiling panels.

6. A multi-floor building according to claim 1, wherein each building consists of the tetrahedral element, the first and second tension members, and the square floor panel.

7. A modular building block for constructing a building, consisting essentially of:

a tetrahedral element that includes six bars fixed to each other at four vertexes, two of the vertexes being lower vertexes and two of the vertexes being upper vertexes disposed at a vertical location above the two lower vertexes;

first and second tension members, the first tension member including a first end that is fixed to a first one of the upper vertexes and a second end, and the second tension member including a first end that is fixed to a second one of the upper vertexes and a second end, and the first and second tension members are parallel to each other and are oriented in a vertical direction; and a floor panel at a base of the modular building block that is oriented horizontally, the floor panel is fixed to the second ends of the first and second tension members and is fixed to the two lower vertexes.

8. The modular building block of claim 7, wherein the floor panel comprises first and second floor panel halves, the first floor panel half is fixed to the second end of the first tension member and is fixed to the two lower vertexes, and the second floor panel half is fixed to the second end of the second tension member and is fixed to the two lower vertexes.

9. The modular building block of claim 7, wherein the floor panel is rectangular.

10. The modular building block of claim 7, wherein one of the six bars of the tetrahedral element bisects the floor panel.

11. The modular building block of claim 7, further comprising a plurality of vertical wall panels connected to the tetrahedral element and the first and second tension members, the vertical wall panels forming an outside perimeter of the modular building block.

12. The modular building block of claim 7, further comprising a horizontal roof panel connected to the tetrahedral element.

13. A building comprising a plurality of the modular building blocks of claim 7 connected to one another.

14. The building of claim 13, wherein the modular building blocks are on one level of the building.

15. The building of claim 13, wherein the building includes a plurality of levels, and each level of the building includes a plurality of the modular building blocks.

16. The modular building block of claim 7, wherein the modular building block consists of the tetrahedral element, the first and second tension members, and the floor panel.

* * * * *